US010427405B2

(12) United States Patent
Ogawa

(10) Patent No.: US 10,427,405 B2
(45) Date of Patent: Oct. 1, 2019

(54) LIQUID DISCHARGING APPARATUS AND INK-JET PRINTER

(71) Applicant: Brother Kogyo Kabushiki Kaisha, Nagoya-shi, Aichi-ken (JP)

(72) Inventor: Masanobu Ogawa, Kasugai (JP)

(73) Assignee: Brother Kogyo Kabushiki Kaisha, Nagoya-shi, Aichi-ken (KR)

( * ) Notice: Subject to any disclaimer, the term of this patent is extended or adjusted under 35 U.S.C. 154(b) by 0 days.

(21) Appl. No.: 15/959,367

(22) Filed: Apr. 23, 2018

(65) Prior Publication Data

US 2018/0304629 A1 Oct. 25, 2018

(30) Foreign Application Priority Data

Apr. 24, 2017 (JP) ..... 2017-084935

(51) Int. Cl.
*B41J 2/14* (2006.01)
*B41J 2/145* (2006.01)

(52) U.S. Cl.
CPC ..... *B41J 2/1433* (2013.01); *B41J 2/145* (2013.01); *B41J 2/14032* (2013.01); *B41J 2/14201* (2013.01); *B41J 2002/14459* (2013.01); *B41J 2002/14475* (2013.01); *B41J 2202/02* (2013.01)

(58) Field of Classification Search
CPC .. B41J 2/1433; B41J 2/14032; B41J 2/14201; B41J 2002/14459; B41J 2/14475; B41J 2/02; B41J 2/145
USPC ..... 347/47
See application file for complete search history.

(56) References Cited

U.S. PATENT DOCUMENTS 8,075,120 B2 12/2011 Ide et al.
2003/0218655 A1* 11/2003 Yokouchi ..... B41J 2/1433 347/40
2005/0140747 A1 6/2005 Batterton et al.
2005/0146560 A1 7/2005 Barss et al.
2005/0146561 A1 7/2005 Bibl et al.
2005/0146569 A1 7/2005 Hoisington et al.
2006/0055731 A1* 3/2006 Yabe ..... B41J 2/1433 347/45
2009/0179939 A1 7/2009 Ide et al.
(Continued)

FOREIGN PATENT DOCUMENTS

JP 2007-516876 A 6/2007
JP 2009-107314 A 5/2009
(Continued)

*Primary Examiner* — Huan H Tran
*Assistant Examiner* — Alexander D Shenderov
(74) *Attorney, Agent, or Firm* — Banner & Witcoff, Ltd.

(57) ABSTRACT

A liquid discharging apparatus includes: a liquid discharging head having nozzles forming a nozzle row along a first direction, and having a nozzle surface in which the nozzles are formed; and a relative movement device configured to relatively move a recording medium and the liquid discharging head in a second direction orthogonal to the first direction. The nozzle surface is formed with first recesses arranged on both sides of the nozzle row in the second direction, and forming two first recess rows each of which is along the nozzle row. The first recesses are separated from each other in the first direction by partition walls, respectively; and a length of an opening of each of the first recesses in the first direction is longer than a length of an end surface of each of the partition walls in the first direction.

16 Claims, 9 Drawing Sheets

(56) References Cited

U.S. PATENT DOCUMENTS

| | | | | |
|---|---|---|---|---|
| 2011/0242220 | A1* | 10/2011 | Yamagishi | B41J 11/0085 347/47 |
| 2016/0257140 | A1* | 9/2016 | Miyakoshi | B41J 2/14 |

FOREIGN PATENT DOCUMENTS

| | | | |
|---|---|---|---|
| JP | 2009-137197 | A | 6/2009 |
| JP | 2011-161770 | A | 8/2011 |
| JP | 2011-177971 | A | 9/2011 |
| JP | 5084478 | B2 | 11/2012 |
| JP | 2016-165886 | A | 9/2016 |
| JP | 2017-030365 | A | 2/2017 |

* cited by examiner

LIQUID DISCHARGING APPARATUS AND INK-JET PRINTER

CROSS REFERENCE TO RELATED APPLICATION

The present application claims priority from Japanese Patent Application No. 2017-084935 filed on Apr. 24, 2017 the disclosure of which is incorporated herein by reference in its entirety.

BACKGROUND

Field of the Invention

The present teaching relates to a liquid discharging apparatus and an ink-jet printer.

Description of the Related Art

A printing apparatus described in Japanese Patent Application Laid-open No. 2017-30365 is provided with a sheet conveying mechanism which conveys a sheet (paper sheet) in a conveying direction, and a line head unit extending in a sheet width direction orthogonal to the conveying direction. The printing apparatus discharges (jets) an ink from nozzles formed in the line head unit onto a sheet conveyed by the conveying mechanism in the conveying direction, thereby performing printing on the sheet.

SUMMARY

When the sheet is conveyed by the sheet conveying mechanism in the above-described printing apparatus, a laminar flow in the conveying direction is generated in the vicinity of a nozzle surface, of the line head unit, in which the nozzles are formed. Further, in a case that this laminar flow collides with an air flow generated accompanying with the discharging of the ink from the nozzles, any disturbance in the air flow is generated around the nozzles. As a result, there is such a fear that a landing position, of the discharged ink, on the sheet might be shifted or deviated from the intended position.

The present teaching has been made in view of the above-described situation, and an object of the present teaching is to provide a liquid discharging apparatus and an ink-jet printer capable of decreasing any deviation of the landing position, of liquid discharged from the nozzles, on a medium.

According to a first aspect of the present teaching, there is provided a liquid discharging apparatus including: a liquid discharging head having nozzles forming a nozzle row along a first direction, and a nozzle surface in which the nozzles are formed; and a relative movement device configured to relatively move a recording medium and the liquid discharging head in a second direction orthogonal to the first direction, wherein the nozzle surface is formed with first recesses which are arranged on both sides of the nozzle row in the second direction, the first recesses form two first recess rows each of which is along the nozzle row, the first recesses are separated from each other in the first direction by partition walls, respectively, and a length of an opening of each of the first recesses in the first direction is longer than a length of an end surface of each of the partition walls in the first direction.

According to a second aspect of the present teaching, there is provided a liquid discharging apparatus including: a liquid discharging head having nozzles forming a nozzle row along a first direction, and a nozzle surface in which the nozzles are formed; and a relative movement device configured to relatively move a recording medium and the liquid discharging head in a second direction orthogonal to the first direction, wherein the nozzle surface is formed with first recesses which are arranged on both sides of the nozzle row in the second direction, the first recesses form two first recess rows each of which is along the nozzle row, and the first recesses arranged on one side of the nozzle row in the second direction are not connected to the first recesses arranged on the other side of the nozzle row in the second direction.

According to a third aspect of the present teaching, there is provided an ink-jet printer including: an ink-jet head having nozzles forming a nozzle row along one direction, riblet grooves forming a groove row along the one direction, and a nozzle surface in which the nozzles and the riblet grooves are formed, the ink-jet head being configured to jet ink droplets of ink from openings of the nozzles, respectively, onto a sheet facing the nozzle surface; and a moving device configured to move the sheet relative to the ink-jet head in an orthogonal direction orthogonal to the one direction, wherein the nozzle surface is formed with: opening surfaces in which the nozzles are open, respectively; and ribs which are connected respectively to the opening surfaces in the orthogonal direction at the same height as the opening surfaces, and which separate the riblet grooves from each other in the one direction, the opening surfaces are connected to each other in the one direction at a same height to form a connected surface, the connected surface separates two groove rows, which include the groove row and which sandwich the nozzle row therebetween in the orthogonal direction, from each other in the orthogonal direction, and a width of an end surface of each of the ribs in the one direction is smaller than a width of an opening of each of the riblet grooves in the first direction.

In the present teaching, the first recesses (riblet grooves) are formed in the nozzle surface on both sides of the nozzle row in the second direction. The length of the opening of each of the first recesses in the first direction is longer than the length, in the first direction, of the end surface of each of the partition walls separating the first recesses from each other in the first direction. Alternatively, the first recesses arranged on the one side of the nozzle row in the second direction are not connected to the first recesses arranged on the other side of the nozzle row in the second direction. Owing to this configuration, in a case that the liquid discharging head and the recording medium are relatively moved in the second direction, a vortex (air flow) is generated in each of the first recesses, which in turn makes any disturbance in the air flow less likely to occur in the vicinity of the nozzles. With this, it is possible to prevent the landing position, of a discharged (jetted) liquid, on the medium from being shifted or deviated from the intended position.

DESCRIPTION OF THE EMBODIMENTS

In the following, an embodiment of the present teaching will be explained, with reference to the drawings.

<Overall Configuration of Printer>

Figure 1:
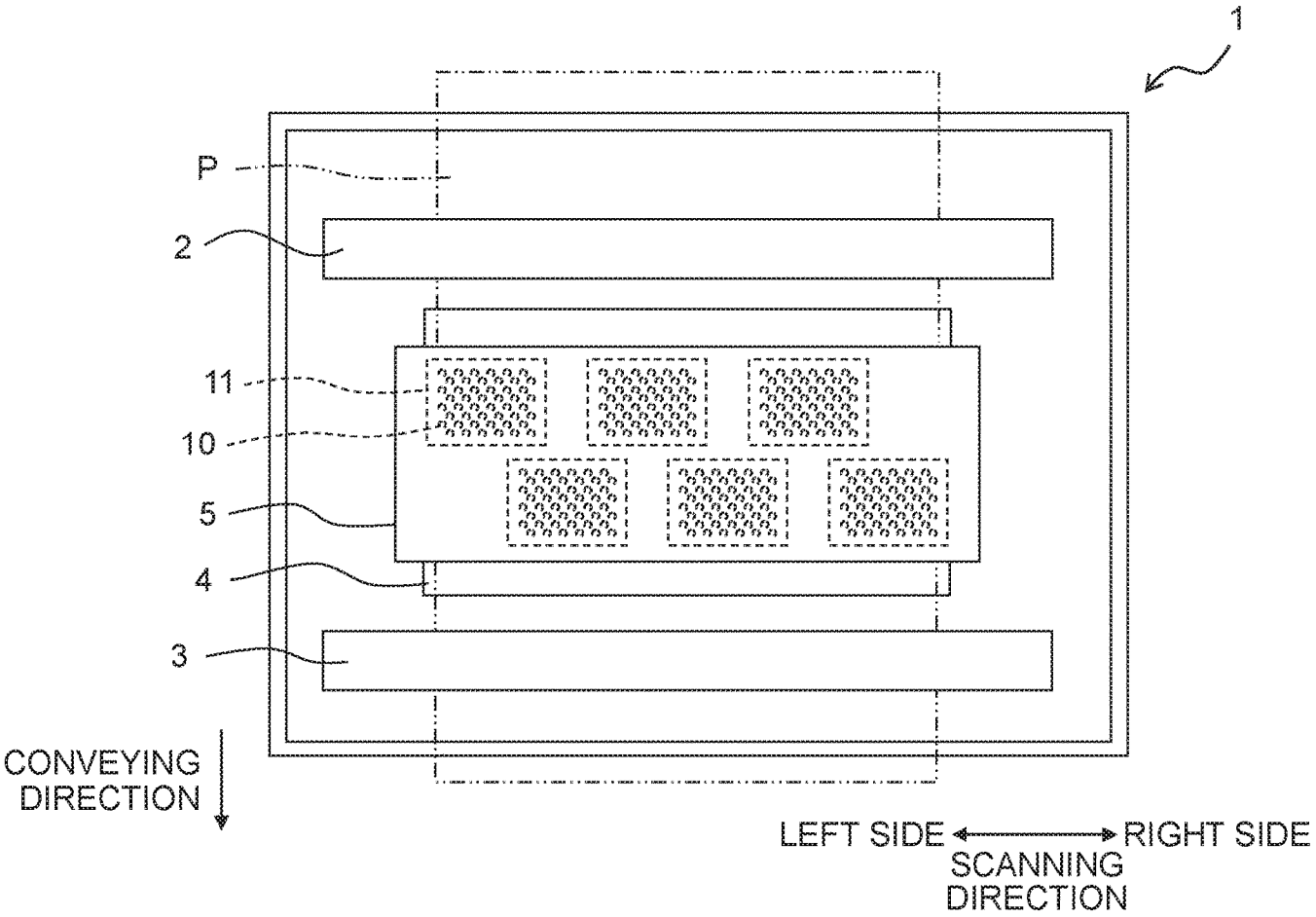
FIG. 1 is a schematic view depicting the configuration of a printer according to an embodiment of the present teaching.

As depicted in FIG. 1, a printer 1 according to a present embodiment (a "liquid jetting apparatus", and "ink-jet printer" of the present teaching) is provided with conveyance rollers 2 and 3 (a "relative movement device", a "conveying device", a "moving device" of the present teaching), a platen 4, an ink-jet head 5 (a "liquid jetting head" or "liquid discharging head" of the present teaching), etc. With respect to a conveying direction (a "second direction", an "orthogonal direction" of the present teaching) of a recording paper P (a "recoding medium" of the present teaching), the conveyance roller 2 is arranged on the upstream side in the conveying direction of the platen 4 and the ink-jet head 5, and the conveyance roller 3 is arranged on the downstream side in the conveying direction of the platen 4 and the ink-jet head 5. The ink-jet head 5 is arranged at a location above the platen 4. The platen 4 and the ink-jet head 5 face each other at a predetermined spacing interval. Each of the platen 4 and the ink-jet head 5 is long in a scanning direction (a "first direction", "one direction" of the present teaching) orthogonal to the conveying direction. The platen 4 supports the recording paper P from therebelow, over the entire width in the scanning direction of the recording paper P. The ink-jet head 5 is also capable of performing printing on the recording paper P over the entire width in the scanning direction of the recording paper P.

The ink-jet head 5 is a so-called line head. The ink-jet head 5 is provided with 6 pieces of a head unit 11. The six head units 11 are arranged side by side along the scanning direction to form two rows which are staggered relative to each other in the scanning direction. A lower surface of each of the head units 11 is a nozzle surface 11*a*. In the nozzle surface 11*a*, nozzles 10 are opened and ink droplets are jetted (discharged) from the nozzles 10. Note that the number of the head unit 11 in the ink-jet head 5 is not limited to as being 6 pieces; the number of the head units 11 may be in a range of 2 to 5, or may be not less than 7.

In a case that the printer 1 performs printing, the conveyance rollers 2 and 3 are driven so as to convey the recording paper P. In a case that the recording paper P is made to face the nozzle surface 11*a*, the ink-jet head 5 jets the ink droplets from the nozzles 10. The ink droplets are jetted based on an image data. A jetting timing at which the ink droplets are jetted is synchronized with the rotations of the conveyance rollers 2 and 3.

<Head Unit>

Next, the configuration of the head unit 11 will be explained. The head unit 11 is a stacked body including a nozzle plate 15, a flow channel member, an actuator, etc. The nozzle plate 15 has the nozzle surface 11*a* in which the nozzles 10 are formed. An ink flow channel, such as a pressure chamber, etc., is formed in the flow channel member and the ink is supplied to the nozzles 10 via the ink flow channel. The actuator is of a piezoelectric type and constructs a part or portion of the pressure chamber. In a case that the actuator is deformed, the ink in the pressure chamber is pushed due to the deformation of the actuator, such that the ink is jetted from openings of the nozzles. In the following, the configuration of the nozzle plate 15 (mainly the nozzle surface 11*a*) will be explained.

As depicted in FIGS. 2, 3 and 4C to 4C, 8 pieces of a nozzle row 9 which are arranged side by side in the conveying direction are formed by the nozzles 10. Each of the eight nozzle rows 9 extends in the scanning direction. Two rows of the eight nozzle rows 9 form one pair, thereby forming four pair in total; and different color inks are supplied from the four pairs, respectively. In the present embodiment, the four pairs correspond, in an order from a pair on the upstream side in the conveying direction, to four color inks which are black, yellow, cyan and magenta inks, respectively. In the one pair of nozzle rows 9, the nozzles 10 are arranged side by side in a staggered form at a regular interval. Among the eight nozzle rows 9, four nozzles 10 are aligned in the conveying direction, and jet mutually different color inks, respectively. Note that in FIGS. 2 and 3, in the nozzle surface 11*a* of each of the nozzle units 11, an area which is flat and located at a same height is hatched. Namely, openings of the nozzles 10 and openings of riblet grooves 25 and 27 (to be described later on) are not hatched.

The nozzle surface 11*a* is partitioned by the openings of the nozzles 10 and the openings of the riblet grooves 25 and 27 such that the nozzle surface 11*a* has opening surfaces 21 and dummy surfaces 22, 23 and 24.

Each of the opening surfaces 21 has a planar shape which is substantially rectangular, and one of the nozzles 10 is open in a central portion of each of the opening surfaces 21. Each of the dummy surfaces 22 has a planar shape which is similar to that of the opening surface 21, although no nozzle 10 is open in each of the dummy surfaces With respect to one nozzle row 9 among the nozzle rows 9, a plurality of pieces of the opening surfaces 21 corresponding thereto are connected to one another respectively at corner portions thereof. Further, two pieces of the dummy surface 22 are connected on each of the both sides in the scanning direction of the opening surfaces 21 in one nozzle row 9. These opening surfaces 21 and dummy surfaces 22 form an elongated connected surface in a row. Eight pieces of the connected surface are formed to correspond to the eight nozzle rows 9, respectively.

Figure 2:
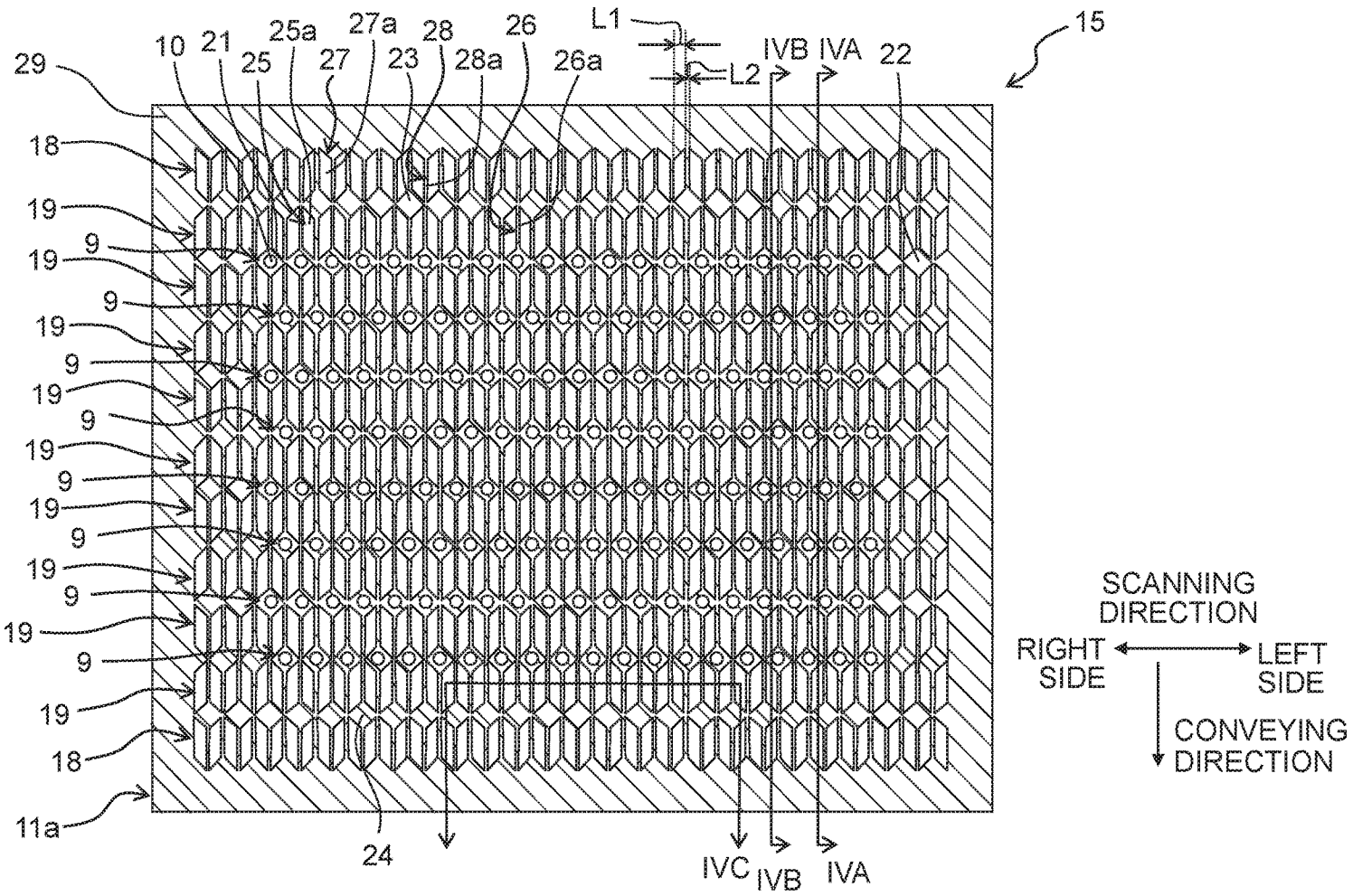
FIG. 2 is a plan view of a nozzle surface of a head unit constructing an ink-jet head.
Figure 3:
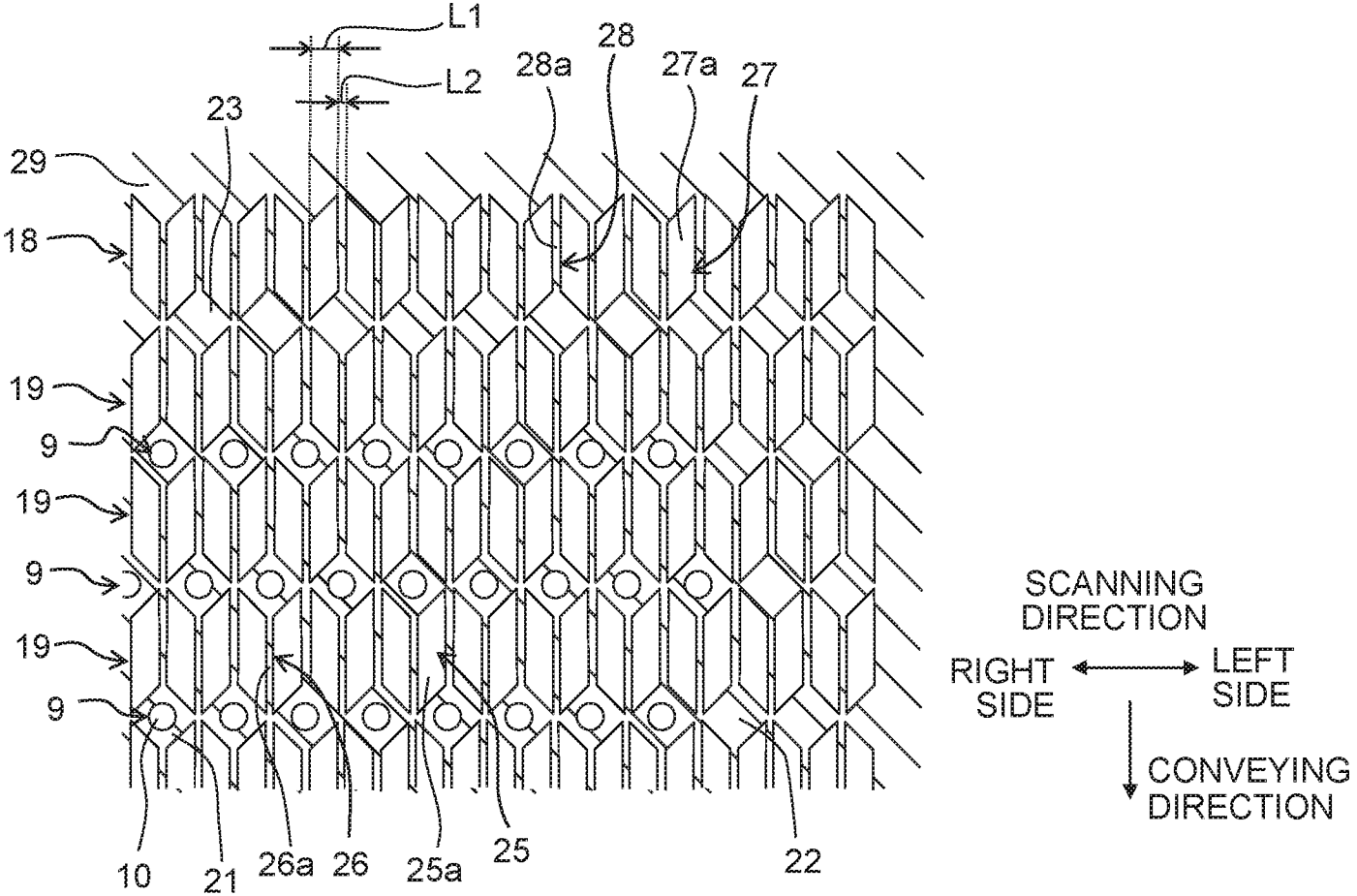
FIG. 3 is a partially enlarged view of FIG. 2.
Figure 4A:
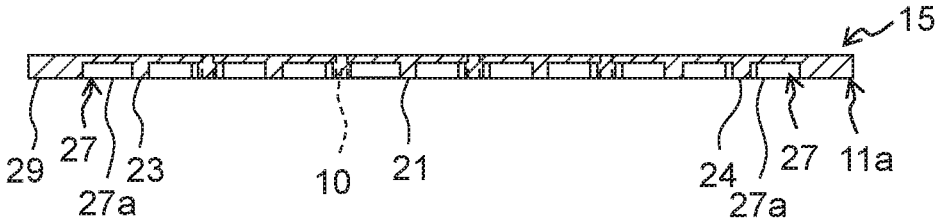
FIG. 4A is a cross-sectional view taken along a line IVA-IVA of FIG. 2.
Figure 4B:
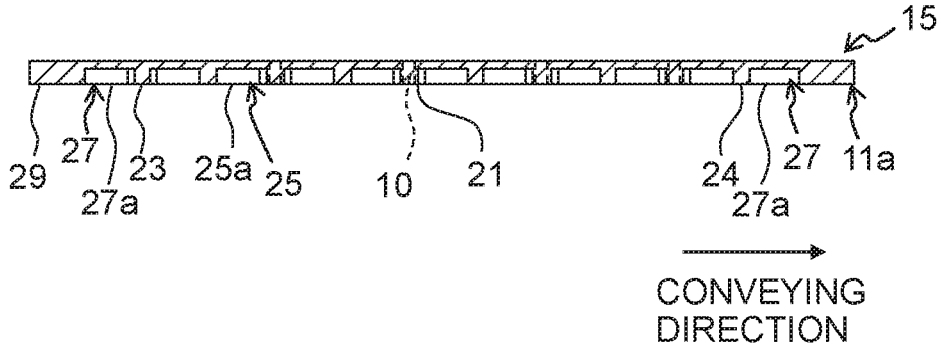
FIG. 4B is a cross-sectional view taken along a line IVB-IVB of FIG. 2.
Figure 4C:
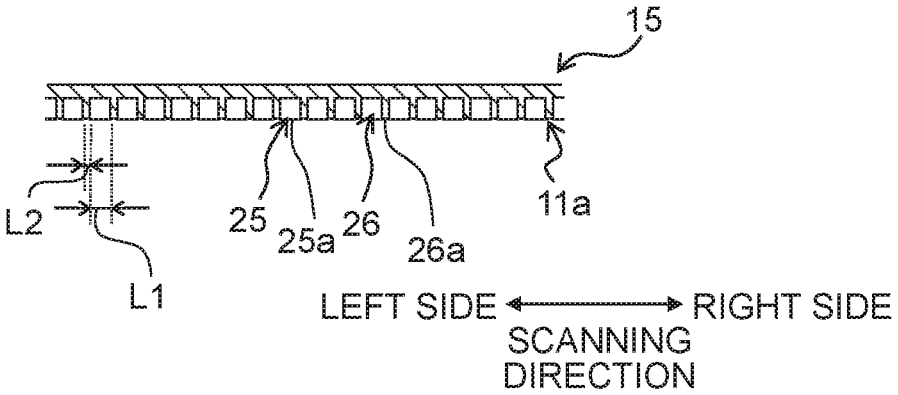
FIG. 4C is a cross-sectional view taken along a line IVC-IVC of FIG. 2.

Furthermore, an elongated dummy connected surface of the dummy surfaces is arranged each on the both sides in the conveying direction of the eight connected surfaces. These dummy connected surfaces are constructed only of the dummy surfaces 23 and 24. The dummy connected surface on the upstream side in the conveying direction is constructed only of the dummy surfaces 23. The dummy connected surface on the downstream side in the conveying direction is constructed only of the dummy surfaces 24. The two dummy surfaces 23 and 24 are also have a planar shape similar to that of the opening surface 21, but no nozzle 10 is open in the two dummy surfaces 23 and 24. As depicted in FIG. 2, all the opening surfaces 21 and all the dummy surfaces 22, 23 and 24 are arranged to be staggered to one another at a regular interval in the scanning direction.

Two pieces of the riblet groove 25 (corresponding to a "first recess" of the present teaching) are arranged, to be adjacent to one piece of the opening surface 21 and one piece of the dummy surface 22, on each of the both sides thereof in the conveying direction. Two pieces of the riblet groove 25 are located between two adjacent nozzles 10, which are included in the nozzles 10 and adjacent to each other in the scanning direction. Further, with respect to each of the dummy surfaces 23, two pieces of the riblet groove 25 are arranged to be adjacent to each of the dummy surfaces 23 from the downstream side in the conveying direction, and two pieces of the riblet groove 27 (corresponding to a "second recess" in the present teaching) are arranged to be adjacent to each of the dummy surfaces 23 from the upstream side in the conveying direction. Similarly, with respect to each of the dummy surfaces 24, two pieces of the riblet groove 25 are arranged to be adjacent to each of the dummy surfaces 24 from the upstream side in the conveying direction, and two pieces of the riblet groove 27 are arranged to be adjacent to each of the dummy surfaces 24 from the downstream side in the conveying direction. In the scanning direction, the riblet moves 25 are arranged side by side at an equal interval so as to form one groove row 19 (corresponding to a "first recess row" in the present teaching); similarly, in the scanning direction, the riblet grooves 27 are arranged side by side at an equal interval so as to form one groove row 18 (corresponding to a "second recess row" in the present teaching).

In the present embodiment, 11 pieces of the groove row and 10 pieces of the connected surface are arranged alternately in the conveying direction. In this situation, two pieces of the groove row 18 are located respectively at the most upstream side and the most downstream side in the conveying direction, and sandwich 9 pieces of the groove row 19 and 10 pieces of the connected surface therebetween in the conveying direction. With respect to the 10 pieces of the connected surface, 2 pieces of the dummy connected surface are located respectively at the most upstream side and the most downstream side in the conveying direction, and 8 pieces of the connected surface are sandwiched in the conveying direction by the 2 pieces of the dummy connected surface. In an area sandwiched by 2 pieces of the groove row 18, one piece of the groove row 19 is formed between two adjacent connected surfaces among the 10 pieces of the connected surfaces. With respect to the conveying direction, each groove row 19 is not connected or linked to the other groove rows 18 and 19 different therefrom.

Here, each of the riblet grooves 25 has a constant depth (for example, a depth in a range of 0.1 mm to 0.3 mm). The length in the conveying direction of the opening 25*a* of each of the riblet grooves 25 is approximately 0.5 mm. Two pieces of the riblet groove 25 are partitioned (isolated) from each other in the scanning direction by one piece of a rib 26 (corresponding to a "partition wall" of the present teaching). A length L1 in the scanning direction of the opening 25*a* of each of the riblet grooves 25 is longer than a length L2 in the scanning direction of an end surface 26*a* (lower end surface) of each of the ribs 26. Specifically, the length L1 is 37.5 μm and the length L2 is 5 μm. The riblet groove 27 has a size and a shape which are same as those of the riblet groove 25. Two pieces of the riblet groove 27 are also partitioned in the scanning direction by one piece of a rib 28. The size and magnitude relationship among an opening 27*a* of the riblet groove 27 and an end surface 28*a* (lower end surface) of the rib 28 are similar to the size and magnitude relationship among the opening 25*a* of the riblet groove 25 and the end surface 26*a* of the rib 26. The rib 26 extends in the conveying direction and connects the connected surfaces which are adjacent to the rib 26 in the conveying direction. The rib 28 also extends in the conveying direction, and is connected to dummy connected surfaces which are included in the dummy connected surfaces and which are adjacent in the conveying direction to the rib 28. Note that the opening surfaces 21, the dummy surfaces 22, 23 and 24, and the end surface 26*a* and the end surface 28*a* are each a portion or part of the nozzle surface 11*a*, and are connected to each other.

Note that in the present embodiment, a portion or part, of the nozzle surface 11*a*, which is constructed of the opening surfaces 21, the openings 25*a* of the riblet grooves 25, and the end surfaces 26*a* of the ribs 26 corresponds to a "discharge area" of the present teaching. Further, a portion or part, of the nozzle surface 11*a*, which is constructed of the dummy surfaces 22, 23 and 24, the openings 27*a* of the riblet grooves 27, the openings on the both sides in the scanning direction of each of the groove rows 19, and end surfaces 28*a* of the ribs 28 corresponds to a "dummy area" of the present teaching. Furthermore, the dummy area surrounds the entire circumference of the discharge area.

Moreover, in the nozzle surface 11*a*, a flat part 29 (corresponding to a "flat area" of the present teaching) surrounds the entire circumference of each of the discharge area and the dummy area. In the flat part 29, the openings of the nozzles and the grooves, etc., are absent. As described above, the three areas are formed in one piece of the nozzle surface 11*a* in a compact manner.

Here, the nozzle plate 15 is formed by performing, for example, a laser processing for a silicone substrate so as to form the nozzles 10, and by forming the riblet grooves 25 and 27 for example with the dry etching. In this situation, a liquid repellent film may be formed on a surface, of the nozzle plate 15, which is to be the nozzle surface 11*a*. Further, a DLC (Diamond Like Carbon), etc., may be deposited on the nozzle surface 11*a* processed to have concavities and convexities, so as to secure the strength. In this situation, it is allowable to sandwich an inclined (graded) layer formed, for example, of Cr—CrN, etc., between the DLC layer and the surface of the nozzle plate 15, so as to secure the adhesion property of the DLC layer. Note that the DLC itself has a liquid repelling property, and can be used also as a liquid repellent film.

Figure 5A:
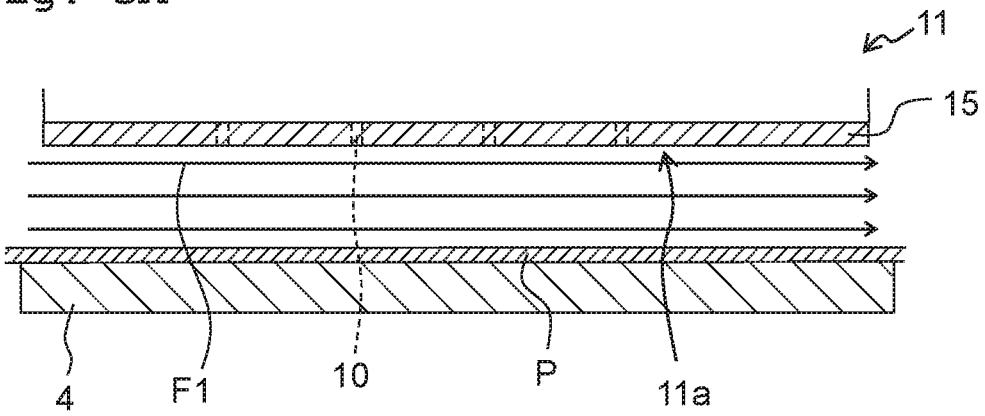
FIG. 5A is a view for explaining an air flow generated due to conveyance of a recording paper in a case that no riblet groove is formed.

Here, when printing is (being) executed, two kinds of air flow are generated between the nozzle surface 11*a* and the recording paper P. Namely, an air flow accompanying with the conveyance of the recording paper P, and an air flow along a flying path of the ink droplets. In a case that the riblet grooves 25 are not provided in the nozzle surface 11*a*, only a laminar flow in the conveying direction is generated in the vicinity of the nozzle surface 11*a*, as indicated by an arrow F1 depicted in FIG. 5A. If the ink is jetted from the nozzles 10 in this state, two kinds of the air flow collide with each other, thereby generating any disturbance in the air flow in the vicinity of the nozzles 10. Due to this, there is such a fear that the flying direction of the ink might be changed, which in turn might cause a landing position, of the discharged (jetted) ink, on the sheet to be shifted or deviated from the intended position.

In view of this, in the present embodiment, the riblet grooves 25 are formed in the nozzle surface 11*a*. In a case that the recording paper P is conveyed, the air flow accompanying with this conveyance induces a small, spiral air flow (vortex air flow) in each of the riblet grooves 25. The spiral air flow tends to remain in the riblet groove 25, and a part or portion of the spiral air flow spreads to the outside of the riblet groove 25 (see an arrow F2 depicted in FIG. 5B). In this situation, the air flow accompanying with the conveyance is made to recede from the nozzle surface 11*a*, to an extent corresponding to the spreading of the spiral air flow to the outside of the riblet groove 25. Therefore, at least the ink droplets are not influenced (affected) by the disturbance in the air flow, at least during the beginning of the jetting. With this, on the recording paper P, any shift or deviation in the landing position of the ink droplets from the intended position are mitigated. Further, the riblet grooves 25 are arranged on the both sides in the conveying direction of each of the nozzle rows 9. Accordingly, any shift or deviation in the landing position is mitigated more effectively. In the present embodiment, such a printer is intended wherein the spacing distance between the nozzle surface 11*a* and the recording paper P is in a range of 0.5 mm to 4.0 mm, and the conveying speed of the recording paper P is not less than 60 m per minute.

Figure 5B:
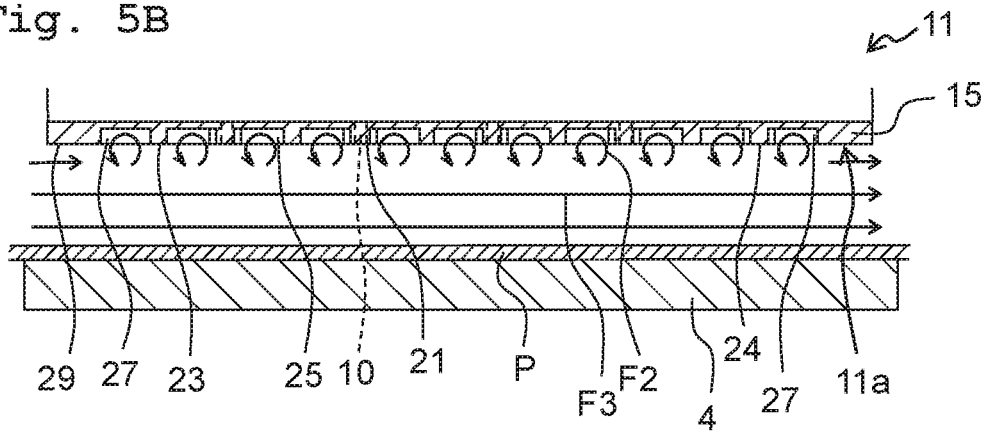
FIG. 5B is a view corresponding to FIG. 5A in a case of the embodiment of the present teaching.

Note that as depicted in FIG. 5B with an arrow F3, the air flow accompanying with the conveyance and the air flow accompanying with the jetting collide with each other at a position located to be separated away from the nozzle surface 11*a* downwardly, which in turn generates the disturbance in air flow. However, this disturbance in air flow is separated away from the nozzle surface 11*a*. Accordingly, any shift or deviation in the landing position is small, as compared with in a case wherein any riblet grooves 25 are not formed.

To provide more detailed explanation, the disturbance in the air flow around the ink droplet changes the flying path of the ink droplet. In such a case that the disturbance in the air flow is generated at a location separated away from the recording paper P (a position close to the nozzle surface 11*a*), the time until the ink droplet lands on the recording paper P is long. Thus, the deviation in the landing position becomes great. In contrast, in a case that the disturbance in the air flow is generated at a location close to the recording paper P (at a position separated away from the nozzle surface 11*a*), the time until the ink droplet lands on the recording sheet P is short. Accordingly, the deviation in the landing position is small.

Here, the length L1 in the scanning direction of the opening 25*a* of the riblet groove 25 is longer than the length L2 in the scanning direction of the end surface 26*a* of the rib 26. With this, in a case that the recording paper P is conveyed in the conveying direction, the amount of air flowing along the end surface 26*a* becomes small. As a result, it is possible to make the generation of the air flow in the conveying direction in the vicinity of each of the nozzle rows 9 be less likely.

Figure 5C:
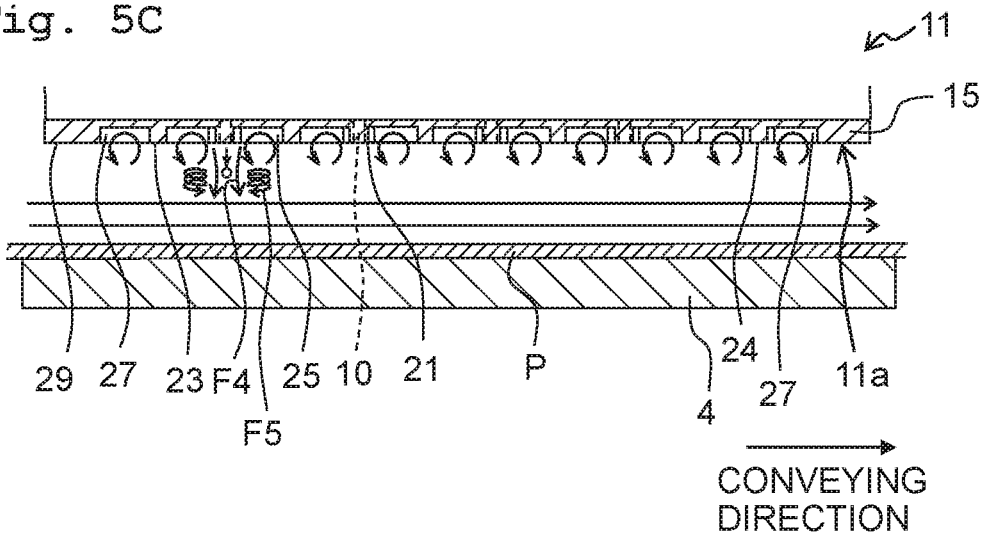
FIG. 5C is a view corresponding to FIG. 5B in a case of discharging an ink droplet from a nozzle.

Further, in a case that the ink is discharged, air flow is generated around the nozzle 10, as indicated by an arrow F4 in FIG. 5C. Further, in a case, for example, that the ink is discharged continuously from a large number of nozzles 10 at the same time, there arises the difference in pressure between a certain area facing the nozzle 10 and another area located outside the certain area. This difference in pressure generates disturbance in air flow (Karman's vortex), as indicated by an arrow F5 in FIG. 5C. Further, in such a case that this disturbance in air flow is moved in the conveying direction by the air flow accompanying with the conveyance of the recording paper P, there is such a fear that the landing position of the ink might be shifted or deviated. The disturbance in the air flow generated in a certain nozzle row 9 is likely to affect a nozzle row 9 which is adjacent to the certain nozzle row 9 on the downstream side in the conveying direction.

In the present embodiment, since the spiral air flow remains in the riblet grooves 25, even if the difference in pressure as described above is generated in the certain nozzle row 9, the disturbance in air flow is less likely to be generated. With this, it is possible to suppress any deviation or shift in the landing position of the ink in nozzle rows 9 located downstream in the conveying direction.

Here, in order to obtain the effect as described above, it is preferred that a stable spiral air flow is generated in the riblet groove 25 in a case that the recording paper P is conveyed in the conveying direction. In the present embodiment, the riblet grooves 25 which are isolated from each other by the ribs 26 are arranged in a row along the nozzle row 9 in the scanning direction. With this, it is possible to generate a stable spiral air flow in each of the riblet grooves 25.

Further, in the present embodiment, each of the riblet groove 25 is not connected to the other riblet grooves 25 different therefrom, and is not connected to the riblet grooves 27, as described above. Accordingly, it is possible to stably retain the spiral air flow in each of the riblet groves 25.

Furthermore, in the present embodiment, a riblet groove 25 arranged on the upstream side in the conveying direction of each of the nozzle rows 9 is located at a position in the scanning direction which is same as that of another riblet groove 25 arranged on the downstream side in the conveying direction of each of the nozzle rows 9. With this, it is possible to generate a stable spiral air flow in each of the riblet groove 25, as compared in a case that the riblet grooves 25 on the upstream and downstream side of each nozzle row 9 in the conveying direction are located at positions which are different in the scanning direction.

Moreover, in the present embodiment, the area in which the riblet grooves 25 are arranged spans or spreads in the scanning direction up to the outer side of the area in which the nozzle rows 9 are arranged. With this, the laminar flow in the conveying direction is less likely to be generated at a position close to the nozzle surface 11*a* within a range, in the scanning direction, wider than the area at which the nozzle rows 9 are arranged.

Further, in the present embodiment, the groove row 18 is arranged each on the upstream side in the conveying direction of a groove row 19 arranged on the most upstream side, and on the downstream side in the conveying direction of a groove row 19 arranged on the most downstream side. With this, regarding any groove row 19 among the groove rows 19, another groove row (groove row 18 or 19) is located each on the both sides in the conveying direction of the groove row 19. Accordingly, a stable spiral air flow is generated in each of the riblet grooves 25 constructing one of the groove rows 19.

Furthermore, each of the riblet grooves 27 forming the groove row 18 has a same shape and a same size as those of one of the riblet groove 25 forming the groove row 19. Moreover, each of the riblet grooves 27 is located at a same position in the scanning direction as that of one of the riblet grooves 25. With this, it is possible to generate a stable spiral air flow in each of the riblet grooves 25 in a more ensured manner.

Moreover, in the embodiment, the flat part 29 is formed each on the upstream side of the groove row 18 which is arranged on the upstream side in the conveying direction, and on the downstream side of the groove row 18 which is arranged on the downstream side in the conveying direction, With this, in a case that the recording paper P is conveyed, the air flow enters or flows into the area in which the riblet grooves 25 and 27 are formed via the flat part 29. With this, it is possible to generate a stable spiral air flow in teach of the riblet grooves 25 and 27.

Next, a modification in which a variety of kinds of changes are added to the present embodiment will be explained.

In the embodiment, although the nozzle surface 11*a* is constructed of the three areas (the discharge area, dummy area and flat part), there is no limitation to this. For example, two areas (the discharge area and the dummy area) may be formed in the nozzle surface 11*a*, and the fiat part may be substituted by a flat surface of another member. For example, it is allowable that in the printer 1, a supporting member fixed to the body of the apparatus (for example, a head holder configured to support the head) has openings from which the nozzle surface of the head is exposed. In this situation, a surface surrounding the openings may be made as a fiat part which is flat.

In the above-described embodiment, the riblet grooves 25 and the riblet grooves 27 have a mutually same shape and a mutually same size, and are arranged at a same position in the scanning direction. However, there is no limitation to this. It is allowable that the riblet groove 27 has a shape and a size at least one of which is different from that of the riblet groove 25. Further, each of the riblet grooves 27 may be located at a position in the scanning direction which is shifted with respect to that of one of the riblet grooves 25.

In the embodiment as described above, the groove rows 18 are arranged on both outer sides in the conveying direction of the groove rows 19 which are located on the outermost sides in the conveying direction. However, it is allowable that the groove rows 18 are not arranged on the outer sides in the conveying direction of the groove rows 19 which are located on the outermost sides in the conveying direction.

Further, although the groove row 18 has a shape which is similar to that of the groove row 19, the groove row 18 may have a different shape from that of the groove row 19. For example, it is allowable that the riblet grooves 27 constructing the groove row 18 have a shape different from that of the riblet grooves 25 constructing the groove row 19. It is allowable that the riblet groove 27 has a length in the conveying direction which is either longer or shorter than that of the riblet groove 25. Furthermore, the dummy surfaces 24 and 25 also may have a different shape from that of the opening surface 21. In the above-described embodiment, although the outer shape of the dummy surfaces 23 and 24 is substantially similar to the outer shape of the opening surfaces 21, the outer shape of the dummy surfaces 23 and 24 may be a shape which is long (elongated) at least in one of the conveying direction and the scanning direction, as compared with the outer shape of the opening surfaces 21. In a case that the dummy surfaces 23 and 24 are long in the scanning direction, the width of the riblet grooves 27 becomes longer as compared with that of the riblet grooves 25. In a case that the dummy surfaces 23 and 24 are short in the scanning direction, the width of the riblet grooves 27 becomes shorter as compared with that of the riblet grooves 25. Any of these cases contributes to the generation of a stable spiral air flow in each of the riblet grooves 25.

Moreover, in the embodiment, the area in which the groove rows 19 are arranged spans or spreads in the scanning direction further to the outer side of another area in which the nozzle rows 9 are arranged. However, there is no limitation to this. The groove rows 19 may be arranged only in the another area in which the nozzle rows 9 are arranged.

Further, in the two groove rows 19, of the embodiment, which sandwich each of the nozzle rows 9 in the conveying direction, the positions in the scanning direction of the riblet grooves 25 are aligned. However, there is no limitation to this. It is allowable that the positions of the riblet grooves 25 are shifted in the scanning direction between the groove row 19 on the upstream side and the groove row 19 on the downstream side.

Further, in the above-described embodiment, although each of the riblet grooves 25 and 27 is the groove of which cross-sectional shape is rectangular and of which depth is substantially constant, there is no limitation to this.

Figure 6:
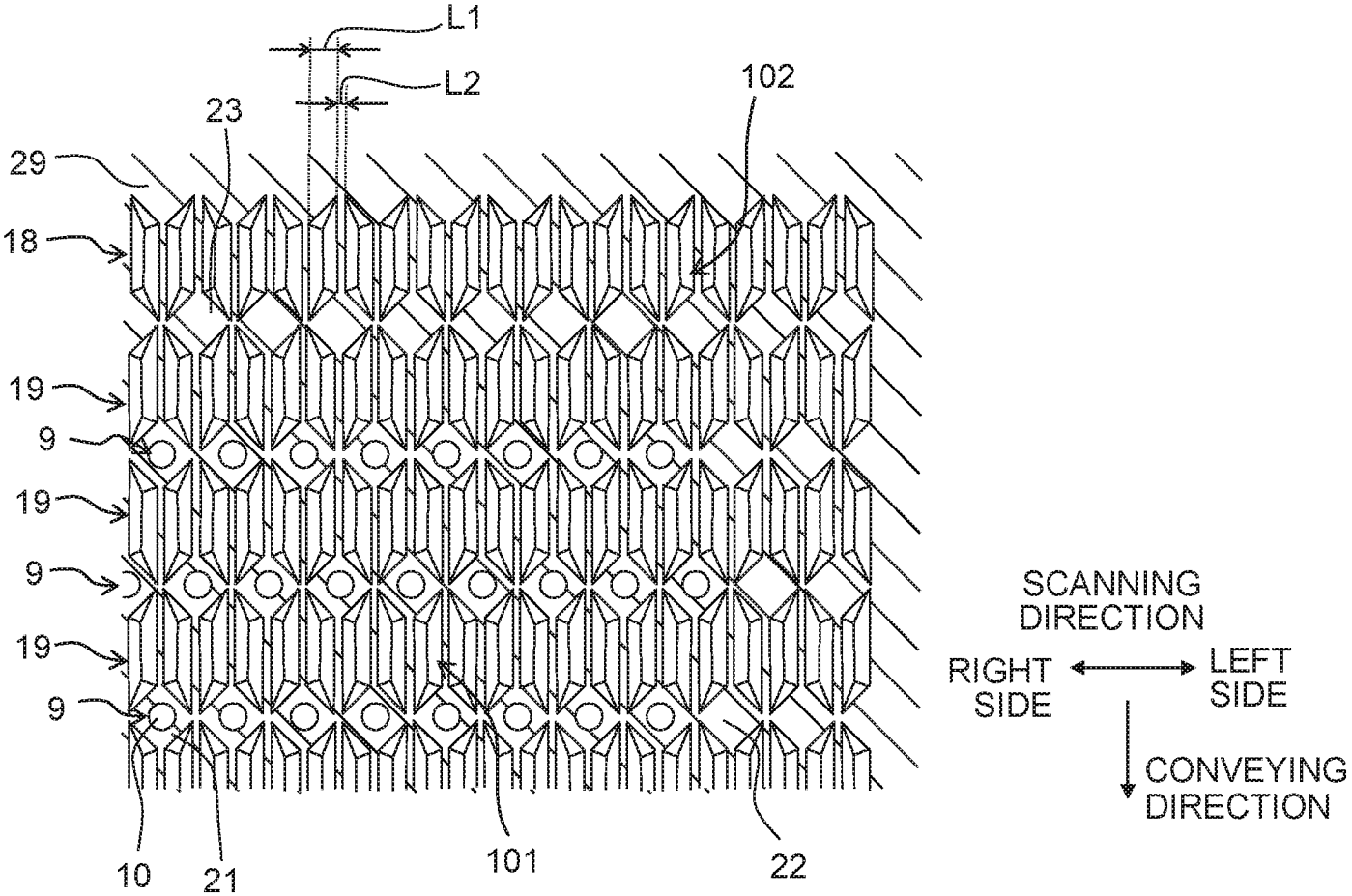
FIG. 6 is a view depicting Modification 1, corresponding to FIG. 3.
Figure 7A:
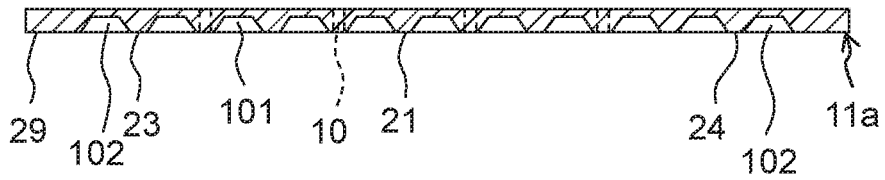
FIG. 7A is a view depicting Modification 1, corresponding to FIG. 4A.
Figure 7B:
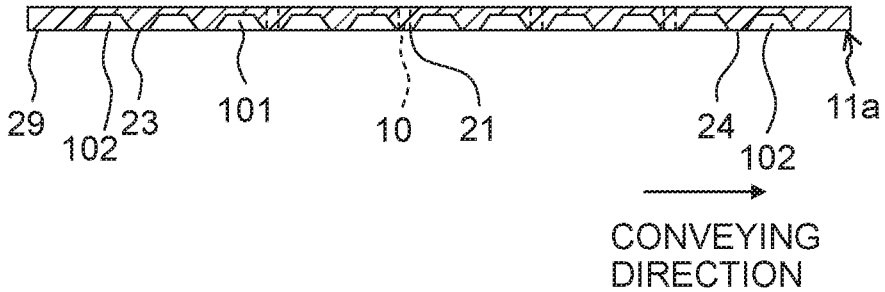
FIG. 7B is a view depicting the modification 1, corresponding to FIG. 4B.
Figure 7C:
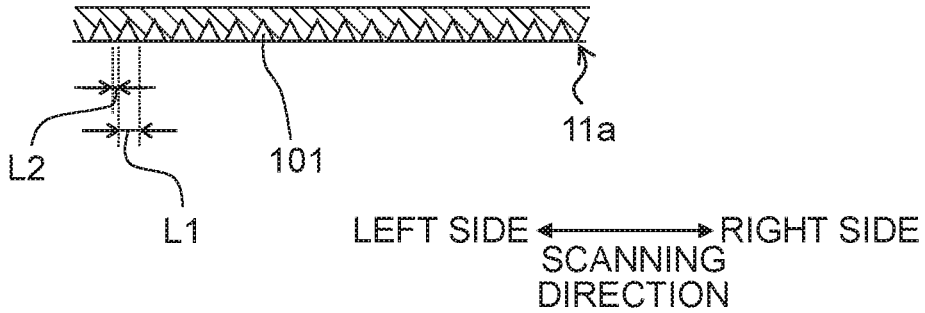
FIG. 7C is a view depicting Modification 1, corresponding to FIG. 4C.

For example, in Modification 1, each of riblet grooves 101 (corresponding to the riblet grooves 25) and each of riblet grooves 102 (corresponding to the riblet grooves 27) have a longitudinal (vertical) cross section which is tapered. As indicated in FIGS. 6 and 7, the depth of groove (distance from the nozzle surface 11*a*) of each of the riblet grooves 101 and 102 becomes greater as approaching closer to a central portion in the conveying direction of the groove. This applies similarly also with respect to the scanning direction, and the cross-section has a V-shape. Note that the depth of each of the riblet grooves 101 and 102 is same as the depth of each of the above-described riblet grooves 25 and 27, and is in a range of 0.1 mm to 0.3 mm.

In Modification 1, the air in the vicinity of the nozzle surface 11*a* flows along a portion or part having the tapered shape, and easily flows into the riblet grooves 101 and 102. With this, it is possible to generate a stable spiral air flow in the riblet grooves 101 and 102.

Further, in Modification 1, sine the riblet grooves 101 and 102 each have a substantially V-shape in the scanning direction, it is possible to allow the spiral air flow stably in the central portion thereof.

Here, the riblet grooves 101 and 102 of Modification 1 can be formed, for example, by performing a wet etching for a (100) surface of a silicone substrate such that the (100) surface of the silicone substrate becomes a nozzle surface.

Further, although in Modification 1, the riblet grooves 101 and 102 are each firmed to have the substantially V-shape in the scanning direction, there is no limitation to this. For example, these riblet grooves may be formed to have a substantially U-shape in the scanning direction so as to have another shape different from that described above, thereby obtaining such a shape that the depth thereof becomes deeper as approaching closer to the central side thereof.

Furthermore, in Modification 1, although the riblet grooves 101 and 102 are each formed to have such a shape that the depth from the nozzle surface 11*a* becomes deeper as approaching closer to the central side thereof, both in the conveying direction and in the scanning direction, there is no limitation to this. The riblet grooves may have such a shape that the depth from the nozzle surface 11*a* becomes deeper as approaching closer to the central side in the conveying direction, and that the depth from the nozzle surface 11*a* is constant in the scanning direction. Alternatively, the riblet grooves may have such a shape that the depth from the nozzle surface Ha becomes deeper as approaching closer to the central side in the scanning direction, and that the depth from the nozzle surface 11*a* is constant in the conveying direction.

Figure 8:
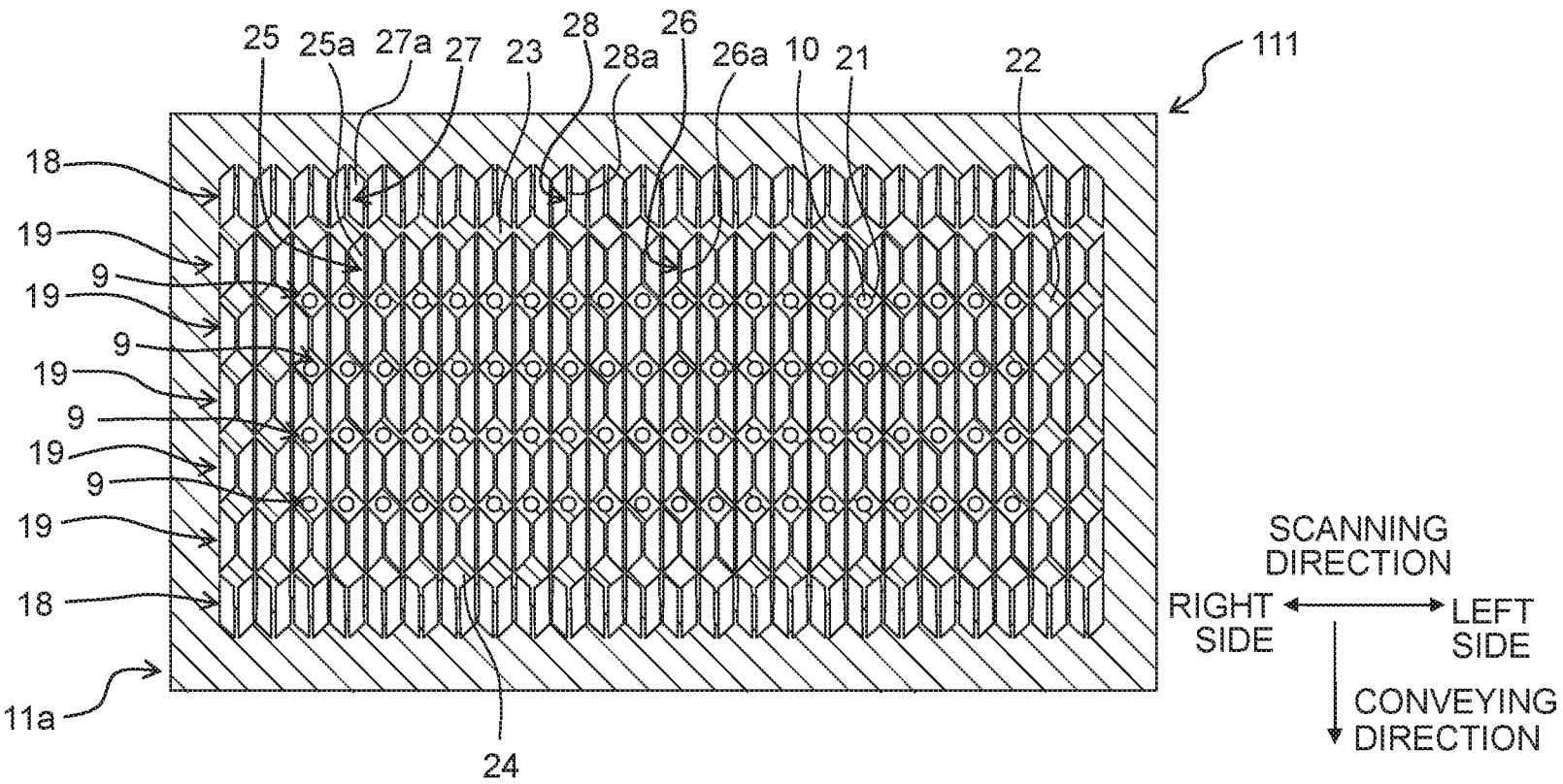
FIG. 8 is a view depicting Modification 2, corresponding to FIG. 2.

Moreover, in the above-described embodiment, although the positions in the scanning direction of the nozzles 10 are shifted from each other in the adjacent nozzle rows 9, there is no limitation to this. In Modification 2, as depicted in FIG. 8, four nozzle rows 9 are formed in a nozzle plate 111. In the four nozzle rows 9, the positions in the scanning direction of nozzles 10 are same. Further, corresponding to this configuration, the positions in the scanning direction of opening surfaces 21 and dummy surfaces 22 are also same in the four nozzle rows 9. Furthermore, dummy surfaces 23 arranged on the upstream side of a nozzle row 9 on the most upstream side in the conveying direction and dummy surfaces 24 arranged on the downstream side of a nozzle row 9 on the most downstream side in the conveying direction have same positions in the scanning direction as those of the opening surfaces 21.

Moreover, in the above-described embodiment, although the riblet grooves 25 on the upstream side of the nozzle row 9 are isolated (separated) in the conveying direction from the riblet grooves 25 on the downstream side of the nozzle row 9 by the continued (linked) opening surfaces 2.1, there is no limitation to this. For example, it is allowable that the riblet grooves 25 on the upstream side are connected (continued) to the riblet grooves 25 on the downstream side by, for example, allowing the opening surfaces 21 which are adjacent to each other in the scanning direction to be separated from each other. In such a case also, provided that the length L1 is longer than the length L2, the amount of the air flowing in the conveying direction along the end surface 26*a* of the rib 26 is made to be small, thereby making it possible to make the generation of the laminar flow in the conveying direction in the vicinity of each of the nozzles 10 be less likely.

Further, in the above-described embodiment, although the length L1 of the opening 25*a* of each of the riblet grooves 25 is longer than the L2 of each of the ribs 26, there is no limitation to this. It is allowable that the length L1 of the opening 25*a* of each of the riblet grooves 25 may be not more than the L2 of one of the ribs 26. In this case also, provided that the riblet grooves 25 on the downstream side of the nozzle row 9 in the conveying direction are not connected to the riblet grooves 25 on the downstream side of the nozzle row 9 in the conveying direction, the air does not flow between the riblet grooves 25 on the upstream side and the riblet grooves 25 on the downstream side, as described above, and thus it is possible to generate the spiral air flow stably in each of the riblet grooves 25.

Furthermore, in the embodiment, although the nozzles 10 are not opened in the dummy surfaces 22, 23 and 24, there is no limitation to this. Dummy nozzles via which the ink is not jetted (discharged) may be open at least in a part of the dummy surfaces 22, 23 and 24.

Figure 9:
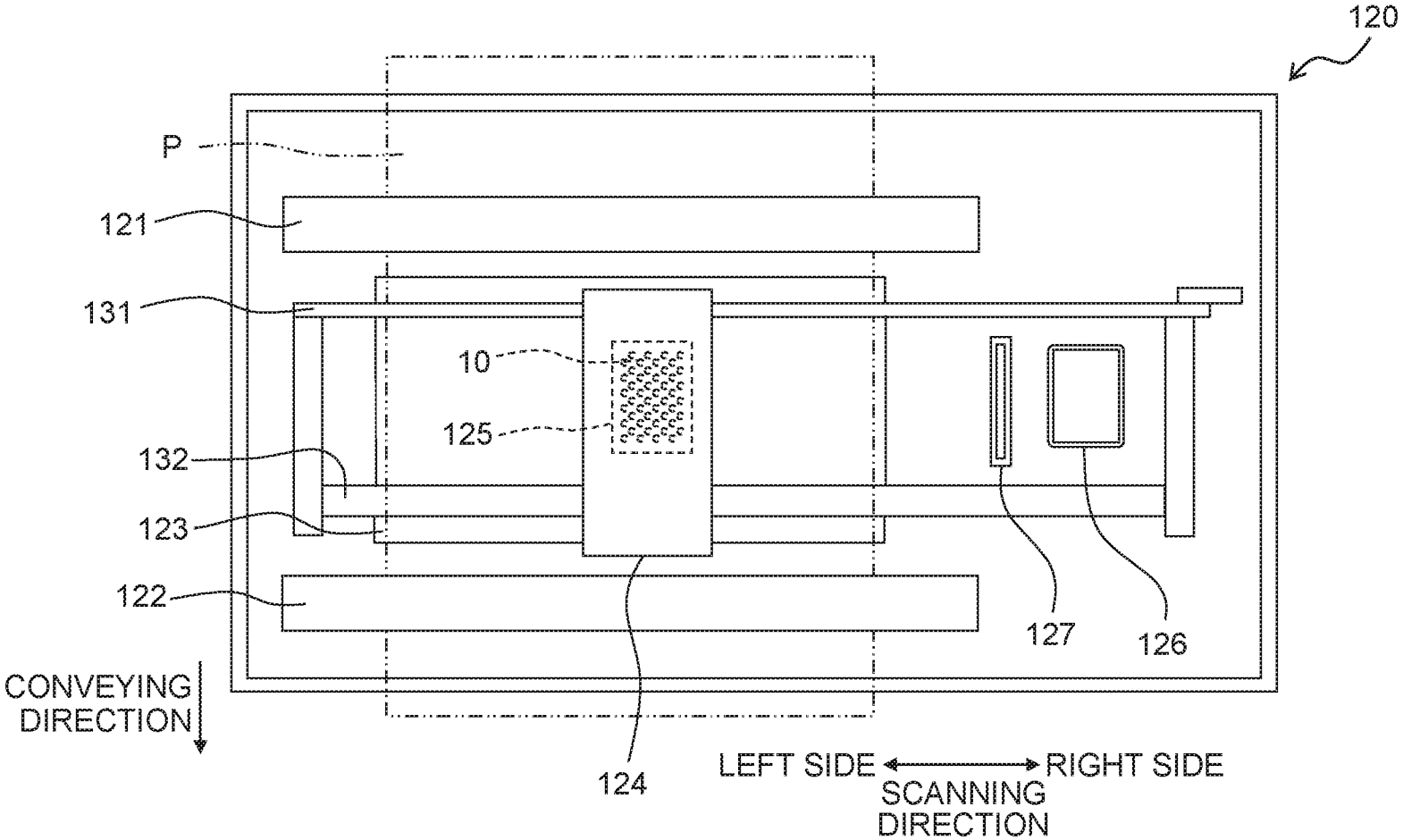
FIG. 9 is a schematic view depicting the configuration of a printer of Modification 3.

Moreover, in the above description, although the example wherein the present teaching is applied to a so-called line printer has been explained, there is no limitation to this. In Modification 3, as depicted in FIG. 9, a printer 120 is provided with conveyance rollers 121 and 122 (corresponding to the "conveying device" of the present teaching), a platen 123, a carriage 124 (corresponding to the "head moving device", the "relative movement device" and the "moving device" of the present teaching), an ink-jet head 125 (corresponding to the "liquid jetting head" or the "liquid discharging head" of the present teaching), a cap 126, a wiper 127, etc. The conveyance rollers 121 and 122 are similar to the above-described conveyance rollers 2 and 3, and convey the recording paper P in the conveying direction (corresponding to the "first direction", the "one direction" of the present teaching). The platen 123 is also similar to the platen 4. The carriage 124 is supported by two guide rails 131 and 132 extending in the scanning direction, and is moved in the scanning direction (corresponding to the "second direction", the "orthogonal direction" of the present teaching), along the guide rails 131 and 132.

The ink-jet head 125 is installed in the carriage 124, and is moved in the scanning direction together with the carriage 124. Namely, the ink-jet head 125 is a so-called serial head. The ink-jet head 125 has a similar configuration or construction to that of the above-described head unit 11. Note that, however, in Modification 3, the ink-jet head 125 has nozzles 10 which are arranged to be parallel to the conveying direction. With this, in Modification 3, the nozzle rows 9 extend in the conveying direction. Further, groove rows 18 and 19 are constructed of riblet grooves 25 and riblet grooves 27, respectively, and extend in the conveying direction.

The cap 126 is located at a stand-by position of the inkjet head 125, and is arranged on the right side in the scanning direction relative to the platen 123. In a case that the carriage 124 is moved up to the stand-by position, the ink-jet head 125 faces the cap 126. The cap 126 is movable upwardly and downwardly. In a case that the cap 126 is move upwardly in a state that the carriage 124 is located at the stand-by position, the cap 126 makes tight contact with the nozzle surface 11*a*. With this, the nozzles 10 are covered by the cap 126, which in turn prevents the ink inside the nozzles 10 from drying. In this situation, the cap 126 makes tight contact with the flat part 29 of the nozzle surface 11*a*. With this, an enclosed space is formed between the nozzle surface 11*a* and the cap 126.

The wiper 127 is arranged between the platen 123 and the cap 126 in the scanning direction. The wiper 127 is also ascendable and descendable. In a case that the carriage 124 is moved between a position at which the carriage 23 faces the platen 123 and the stand-by position in a state that the wiper 127 is ascended, the nozzle surface 11*a* moves while making contact with an upper end of the wiper 127. With this, the ink adhered to the nozzle surface 11*a* is removed by the wiper 127. In this situation, the riblet grooves 25 and 27 are formed in the nozzle surface 11*a*, and the wiper 127 does not contact the bottom surfaces of the riblet grooves 25 and 25. However, the ink inside the riblet grooves 25 and 27 are integrated with the ink adhered to the wiper 127 when the wiper 127 pass over the riblet grooves 25 and 27, and is removed satisfactorily.

Further, in the printer 120, the recording paper P is conveyed by a predetermined distance with the conveyance rollers 121 and 122. Further, every time the recording paper P is conveyed by the predetermined distance with the conveyance rollers 121 and 122, the ink is made to be jetted from the ink-jet head 125 while moving the carriage 124 in the scanning direction. With this, recording is performed on the recording paper P.

In a case that the carriage 124 is moved in the scanning direction, a laminar flow in the scanning direction is generated between the nozzle surface 11*a* and the recording paper P. In Modification 3, the riblet grooves 25 and 27 are formed in the nozzle surface 11*a*, thereby making it possible to suppress any shift or deviation in the landing position of the ink droplets, in a similar manner in the above-described embodiment. Further, in this situation, it is possible to generate a stable spiral air flow in each of the riblet grooves 25, in a similar manner in the above-described embodiment.

Note that also in the embodiment as described above, it is also allowable to provide a cap, which is similar to the cap 126 of Modification 3, individually for each of the head units 11. Further, in the above-described embodiment, it is also allowable to provide a wiper configured to remove an ink adhered to the nozzle surface 11*a* of the head unit 11 in a similar manner in Modification 3 as described above. In this case, it is allowable, for example, a wiper extending in the scanning direction over the entire length in the scanning direction of the ink-jet head 5 is made to move in the conveying direction to thereby remove the ink adhered to the nozzle surfaces 11*a* of the four head units 11.

Furthermore, in the above-described description, although the explanation has been given about the example wherein the present teaching is applied to the ink-jet printer configured to jet the ink from the nozzles so as to perform printing on the recording paper, there is no limitation to this. The present teaching is applicable also to a liquid jetting (discharging) apparatus which is different from the ink-jet recording apparatus and which is configured to jet, from a nozzle, a liquid different from the ink.

What is claimed is:

1. A liquid discharging apparatus comprising:

a liquid discharging head having nozzles forming a nozzle row along a first direction, and having a nozzle surface in which the nozzles are formed; and a relative movement device configured to relatively move a recording medium and the liquid discharging head in a second direction orthogonal to the first direction, wherein the nozzle surface is formed with first recesses which are arranged on both sides of the nozzle row in the second direction, the first recesses form two first recess rows each of which being along the nozzle row, the first recesses are separated from each other in the first direction by partition walls, respectively, and a length of an opening of each of the first recesses in the first direction is longer than a length of an end surface of each of the partition walls in the first direction.

2. The liquid discharging apparatus according to claim 1, wherein the first recesses arranged on one side of the nozzle row in the second direction are not connected to the first recesses arranged on the other side of the nozzle row in the second direction.

3. The liquid discharging apparatus according to claim 1, wherein the first recesses arranged on one side of the nozzle row in the second direction and the first recesses arranged on the other side of the nozzle row in the second direction are located at the same positions in the first direction.

4. The liquid discharging apparatus according to claim 1, wherein with respect to the first direction, each area which the first recesses are arranged spreads up to areas located on both outsides of an area in which the nozzle row is arranged.

5. The liquid discharging apparatus according to claim 1, wherein the liquid discharging head has:

nozzle rows which includes the nozzle row and which are arranged in the second direction; and first recess rows which include the two first recess rows and which are arranged in the second direction, the nozzle surface is further formed with second recesses, the second recesses forming two second recess rows each of which being along the first direction, and with respect to the second direction, the nozzle rows and the first recess rows are located between the two second recess rows.

6. The liquid discharging apparatus according to claim 5, wherein each of the second recesses has the same shape and the same size as each of the first recesses.

7. The liquid discharging apparatus according to claim 5, wherein openings of the first recesses and openings of the second recesses are located at the same positions in the first direction.

8. The liquid discharging apparatus according to claim 5, wherein the nozzle surface has two flat parts, which sandwich the two second recess rows in the second direction, and each of the two flat parts is formed with no recess.

9. The liquid discharging apparatus according to claim 1, wherein each of the first recesses has a depth from the nozzle surface which increases approaching a center of the opening in the first direction.

10. The liquid discharging apparatus according to claim 1, wherein each of the first recesses has a depth from the nozzle surface which increases approaching a center of the opening in the second direction.

11. The liquid discharging apparatus according to claim 1, wherein the nozzle row is formed beyond both edges of the recording medium in the first direction, and the relative movement device is a conveyor configured to convey the recording medium in the second direction.

12. The liquid discharging apparatus according to claim 1, further comprising a conveyor configured to convey the recording medium in the first direction, wherein the relative movement device is a head moving device configured to move the liquid discharging head in the second direction.

13. A liquid discharging apparatus comprising:

a liquid discharging head having a nozzle plate, the nozzle plate having a nozzle surface in which nozzles are formed, the nozzles forming a nozzle row along a first direction; and a relative movement device configured to relatively move a recording medium and the liquid discharging head in a second direction orthogonal to the first direction, wherein the nozzle surface is formed with first recesses which are arranged on both sides of the nozzle row in the second direction, depth of each of the first recesses from the nozzle surface is smaller than thickness of the nozzle plate, the first recesses form two first recess rows each of which being along the nozzle row, and the first recesses arranged on one side of the nozzle row in the second direction are not connected to the first recesses arranged on the other side of the nozzle row in the second direction.

14. An ink-jet printer comprising:

an ink-jet head having nozzles forming a nozzle row along one direction, riblet grooves forming a groove row along the one direction, and a nozzle surface in which the nozzles and the riblet grooves are formed, the ink-jet head being configured to jet ink droplets of ink from openings of the nozzles, respectively, onto a sheet facing the nozzle surface; and a moving device configured to move the sheet relative to the ink-jet head in an orthogonal direction orthogonal to the one direction, wherein the nozzle surface is formed with:

opening surfaces in which the nozzles are open, respectively; and ribs which are connected respectively to the opening surfaces in the orthogonal direction at the same height as the opening surfaces, and which separate the riblet grooves from each other in the one direction, the opening surfaces are connected to each other in the one direction at a same height to form a connected surface, the connected surface separates two groove rows, which include the groove row and which sandwich the nozzle row therebetween in the orthogonal direction, from each other in the orthogonal direction, and a width of an end surface of each of the ribs in the one direction is smaller than a width of an opening of each of the riblet grooves in the one direction.

15. The ink-jet printer according to claim 14, wherein the nozzle surface has:

a discharge area which is constructed of the opening surfaces, openings of the riblet grooves, and end surfaces of the ribs, and which includes nozzles through which the ink droplets are discharged; and a dummy area which is constructed of dummy surfaces having the same shape as the opening surfaces, openings of the riblet grooves, and end surfaces of the ribs, and which does not include the nozzles through which the ink droplets are discharged, and the dummy area surrounds an entire circumference of the discharge area.

16. The ink-jet printer according to claim 15, wherein the nozzle surface has a flat area in which the nozzles and the riblet grooves are not open, and the flat area surrounds an entire circumference of the dummy area.

* * * * *